US006679189B1

(12) United States Patent
Henningfeld

(10) Patent No.: US 6,679,189 B1
(45) Date of Patent: Jan. 20, 2004

(54) CONVERTIBLE SHELVING UNIT

(76) Inventor: William F. Henningfeld, 1607 S. Main St., South Bend, IN (US) 46613

( * ) Notice: Subject to any disclaimer, the term of this patent is extended or adjusted under 35 U.S.C. 154(b) by 29 days.

(21) Appl. No.: 10/054,780

(22) Filed: Jan. 23, 2002

(51) Int. Cl.[7] ..... A47B 9/00
(52) U.S. Cl. ..... 108/106; 108/13
(58) Field of Search ..... 108/1, 106, 107, 108/13, 17; 211/42, 43, 150, 2

(56) References Cited

U.S. PATENT DOCUMENTS

D142,497 S * 10/1945 Rider ..... 211/42
3,010,585 A * 11/1961 Slikkers ..... 108/1
3,044,631 A * 7/1962 Greenman et al. ..... 108/1
3,149,724 A * 9/1964 Magers ..... 211/42
3,295,695 A * 1/1967 Carmstrom ..... 108/107
3,492,057 A * 1/1970 Watson ..... 211/42
3,497,073 A * 2/1970 Bartell ..... 211/2
3,570,679 A * 3/1971 Edson ..... 211/47
5,127,340 A * 7/1992 Maro et al. ..... 108/107

FOREIGN PATENT DOCUMENTS

GB 2028648 A * 3/1980

* cited by examiner

*Primary Examiner*—Jose V. Chen
(74) *Attorney, Agent, or Firm*—Botkin & Hall, LLP

(57) ABSTRACT

A convertible shelving unit with adjustable shelves includes an adaptable shelving system which allows a user to arrange the shelving into horizontal and cradling positions.

7 Claims, 12 Drawing Sheets

CONVERTIBLE SHELVING UNIT

SUMMARY OF THE INVENTION

This invention relates to a convertible shelving unit and will have particular but not limited application to a convertible shelving system having a multi-use adjustable shelving unit.

Heretofore, multi-purpose book trucks have been used to transfer or display books in places such as libraries, retail book stores, and home libraries. The current industry standard utilizes a cart having side walls, a flat lower and upper surface having typically three to five shelves. The shelves are generally permanently fixed in position for increased strength and stability, and are easily transportable on caster wheels. However, there are problems associated with such designs. Although industry standard multi-purpose book trucks are well known for their durability, the permanently placed shelving is inflexible when trying to accommodate items of different shapes, sizes, and the manner in which they can be displayed. The end result for the user is the need to purchase several multi-purpose book trucks in different shapes, sizes, and shelving configurations. In this invention, a convertible shelving unit has shelving that is easily adaptable in allowing the user to arrange the shelving in a variety of different positions. Such a shelving unit allows for greater flexibility without sacrificing durability and can be used not only in a library setting, but at the home or office as well.

Therefore, it is an object of this invention to provide a convertible shelving unit with an easily adaptable shelving system.

Another object of this invention is to provide a shelving unit for transporting and accommodating a variety of products within a home, office, or public building.

Other objects of the invention will become apparent upon a reading of the following description.

DESCRIPTION OF THE PREFERRED EMBODIMENT

Figure 1:
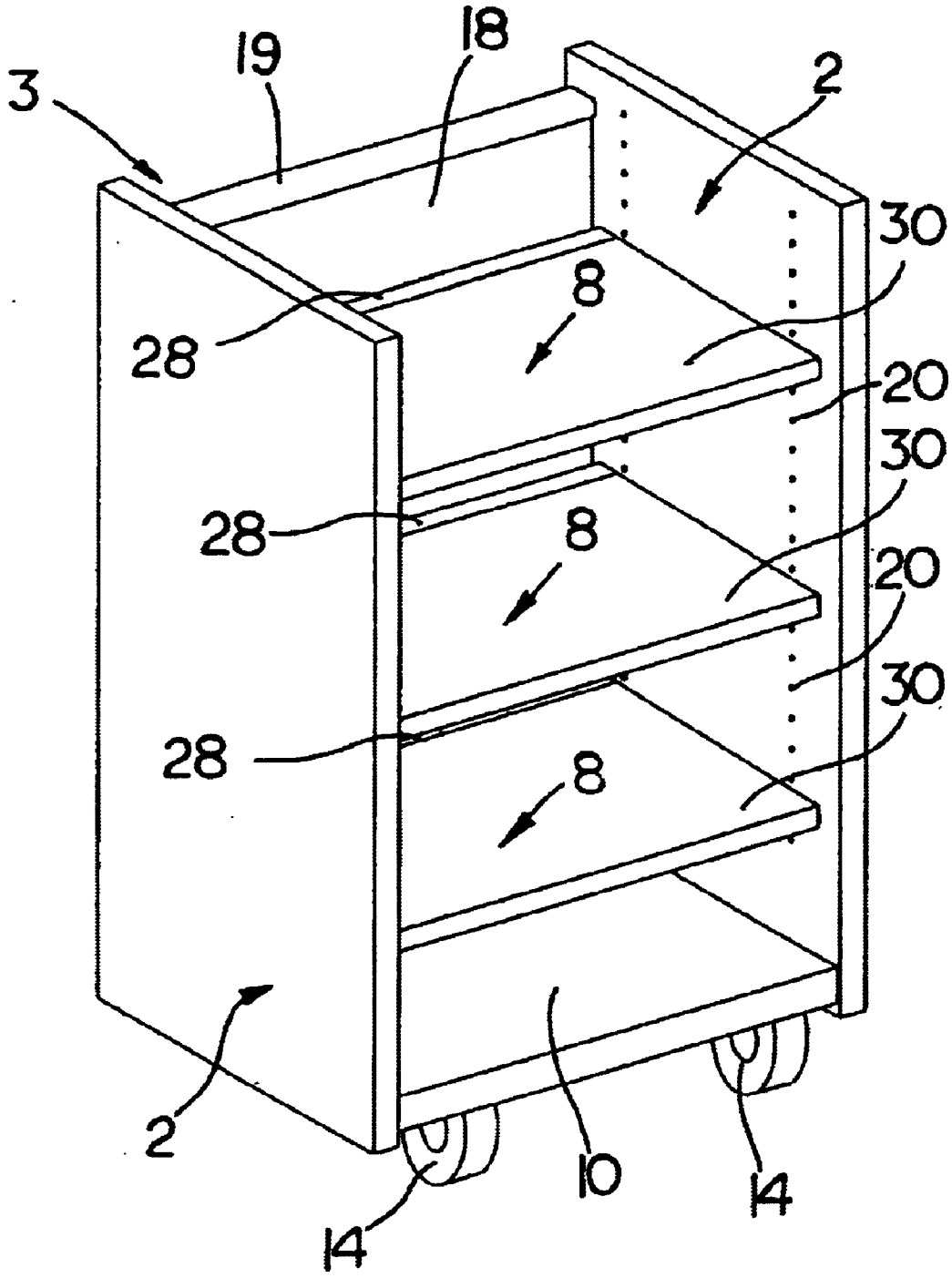
FIG. 1 is a perspective view of the shelving unit in a first operative position having a horizontal configuration.
Figure 2:
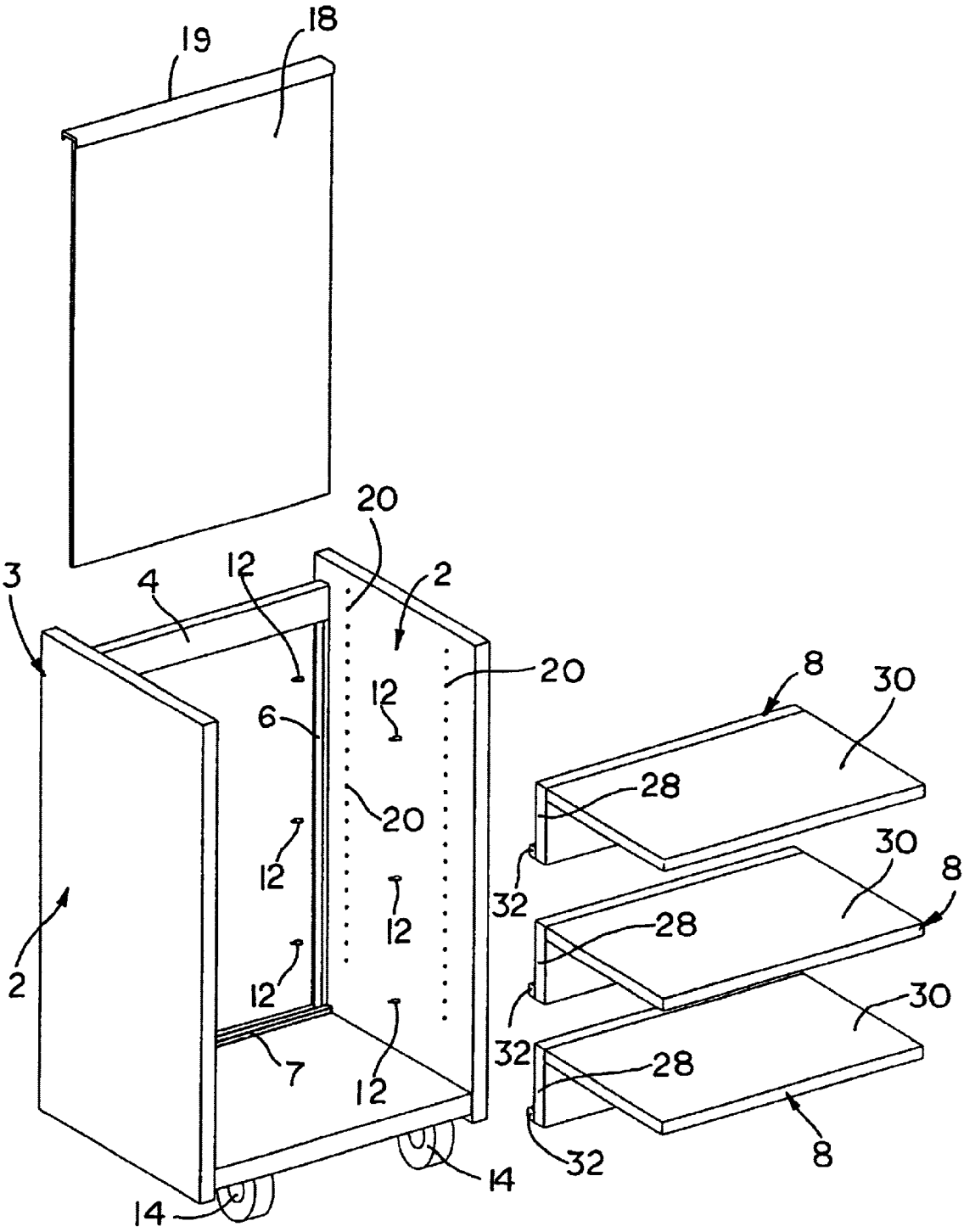
FIG. 2 is a perspective view of the shelving unit in the first operative position showing the component parts in exploded form.

The preferred embodiment illustrated is not intended to be exhaustive or to limit the invention to the precise form herein described but rather it is described in order to enable one having ordinary skill in the art to produce and use the invention.

This invention relates to a convertible shelving unit 1 having a frame 3 and shelves 8. Frame 3 is made up of two side panels 2 and bottom panel 10. Side panels 2 are adapted to accommodate holes 20 which are located in the interior surface 17 of side panels 2 and are aligned into two spaced vertical rows in order to accommodate shelving support pins 12 or retainers. Each pin is placed into a selected hole 20 with its protruding end supporting a shelf 8. This allows for the adaptability of shelving 8 and multiple configurations. Bottom panel 10 is equipped with caster wheels 14 to allow for mobility when the shelving unit is moved to a different location. Side panels 2 are attached perpendicularly to bottom shelf 10. Frame 3 is reinforced by a cross brace 4 which is extended between the top inside corners of side panels 2. In addition, frame 3 has the ability to accommodate a removable back panel 18. Back panel 18 includes an upper grip part 19 and fits between spaced guide rails 6 which are mounted to side panels 2. Guide rails 6 are used to retain and guide back panel 18 into place with the grip part fitting over the upper ends of the guide rails and the lower edge of the panel fitting behind a lower retainer rail 7. Retainer rail 7 is mounted to the bottom panel 10 and extends between guide rails 6

Each shelf 8 is made up a wall part 28, a wall part 30, and a catch 32. Wall part 30 is secured perpendicularly to wall part 30. Catch 32 is mounted to the free edge of wall part 28. The configuration of shelf 8 provides for its variety of uses in conjunction with frame 3.

Figure 3:
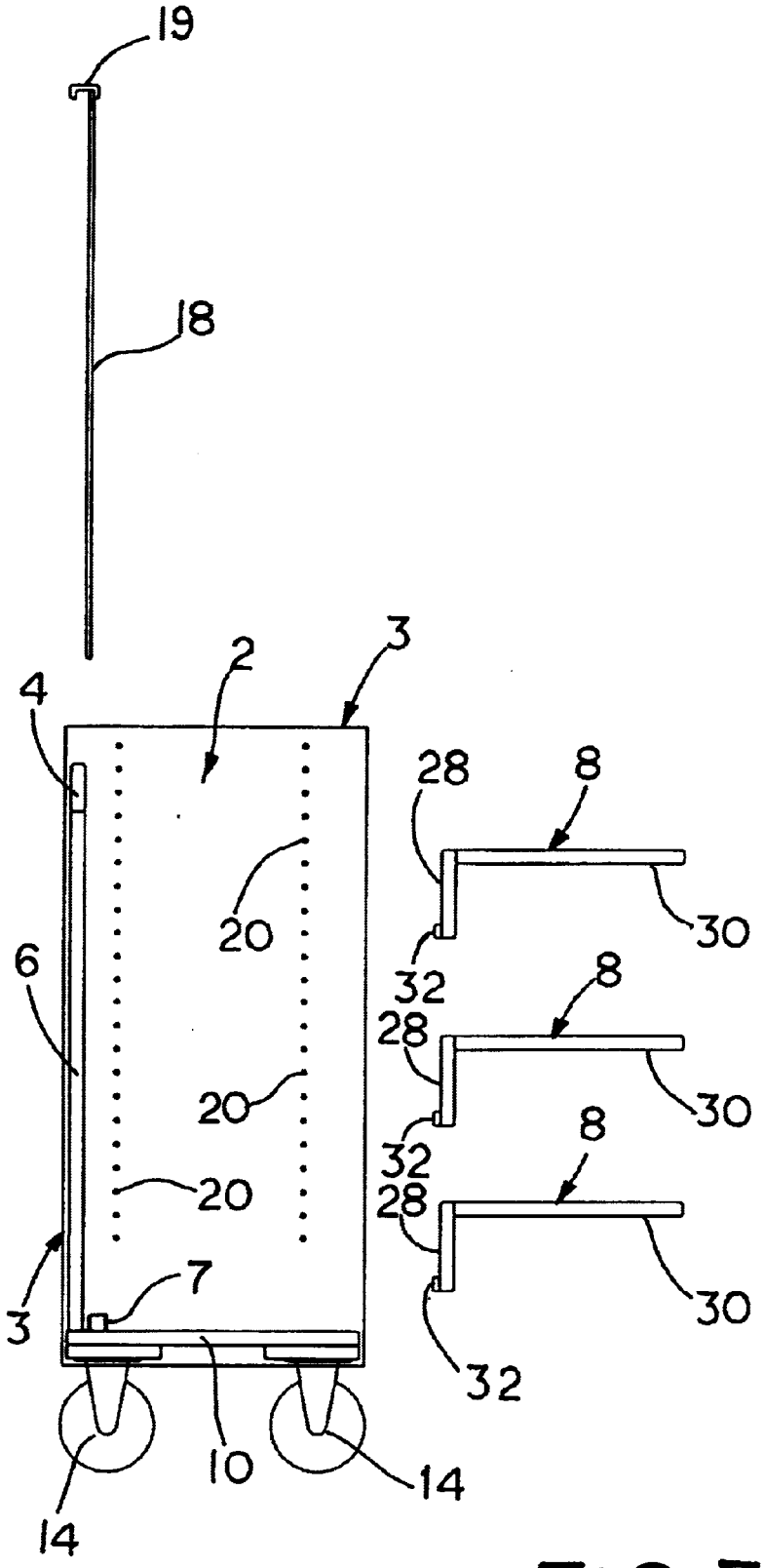
FIG. 3 is a vertical sectional view showing the shelving unit in the first operative position in exploded form.
Figure 4:
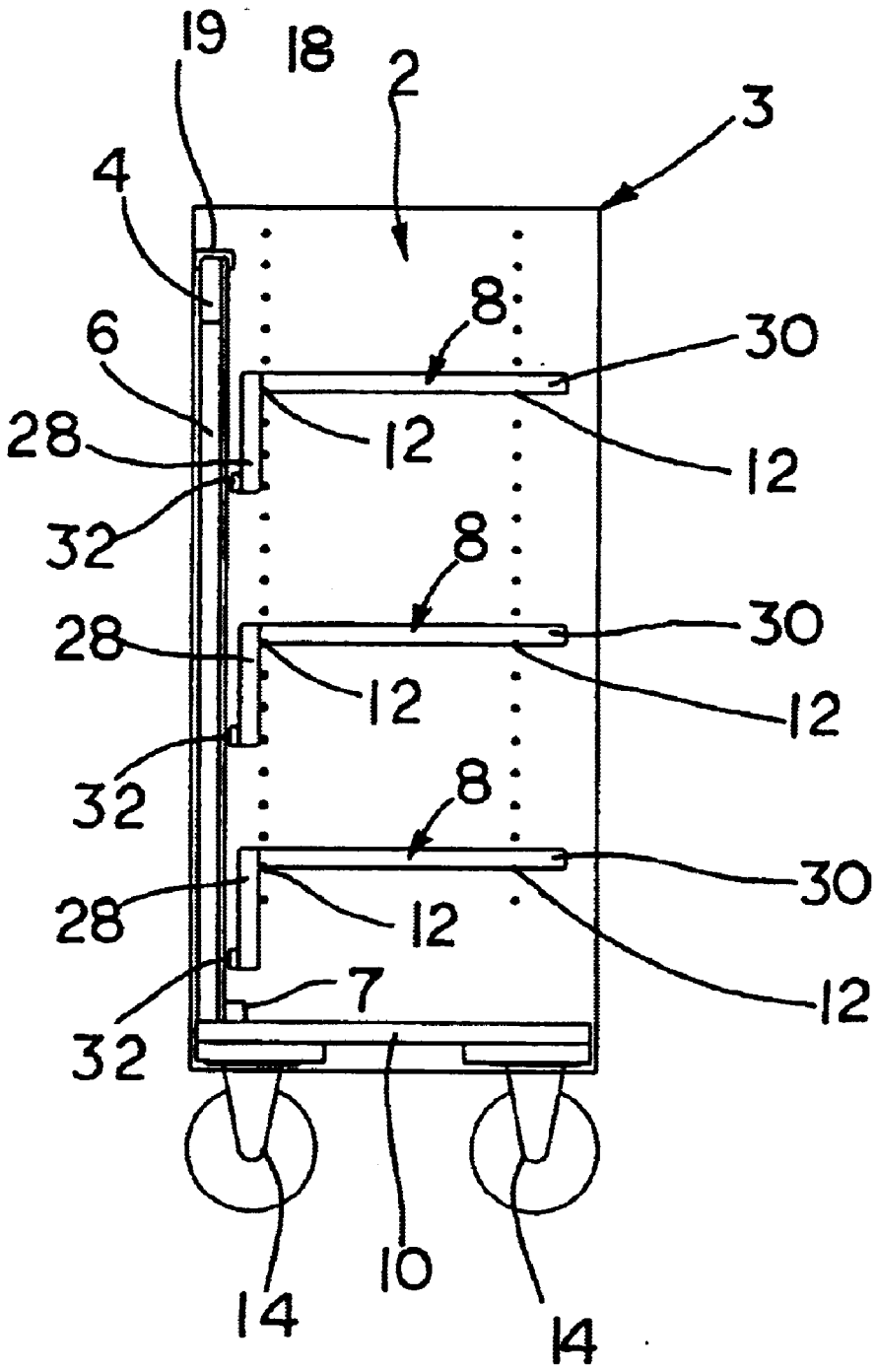
FIG. 4 is a vertical sectional view showing the component parts of the shelving unit in the first operative position.

As seen in FIGS. 1 and 3, shelves 8 are placed in a first operative position. In this first position the pins 12 are located in a horizontally supportive position in holes 20 of frame 3 in which wall part 30 of each shelf rests upon pins 20. This first operative position allows for the storage of books or other similar items, or the display of items needing a horizontally flat display surface.

Figure 5:
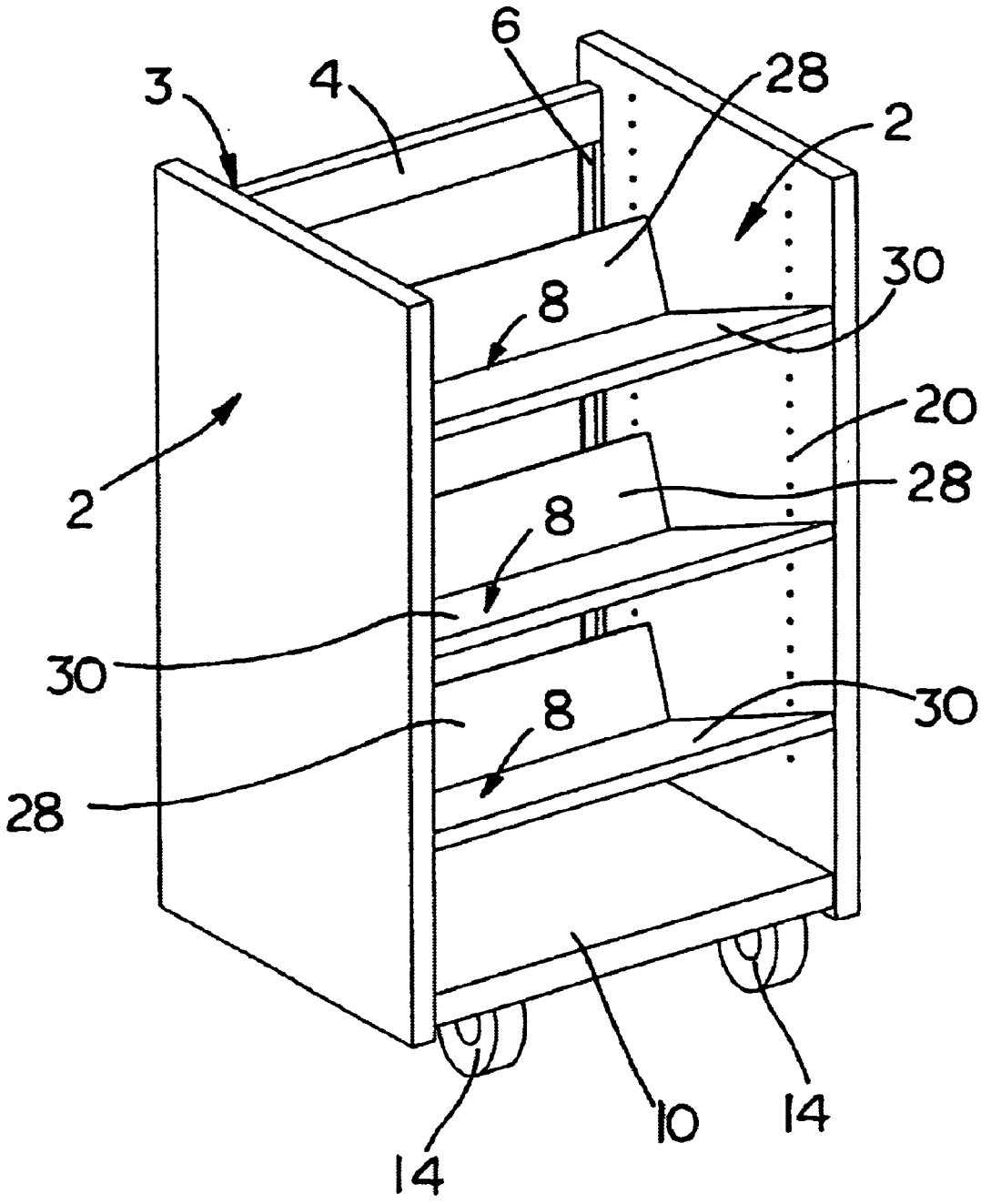
FIG. 5 is a perspective view of the shelving unit in a second operative position having a sloped configuration.
Figure 6:
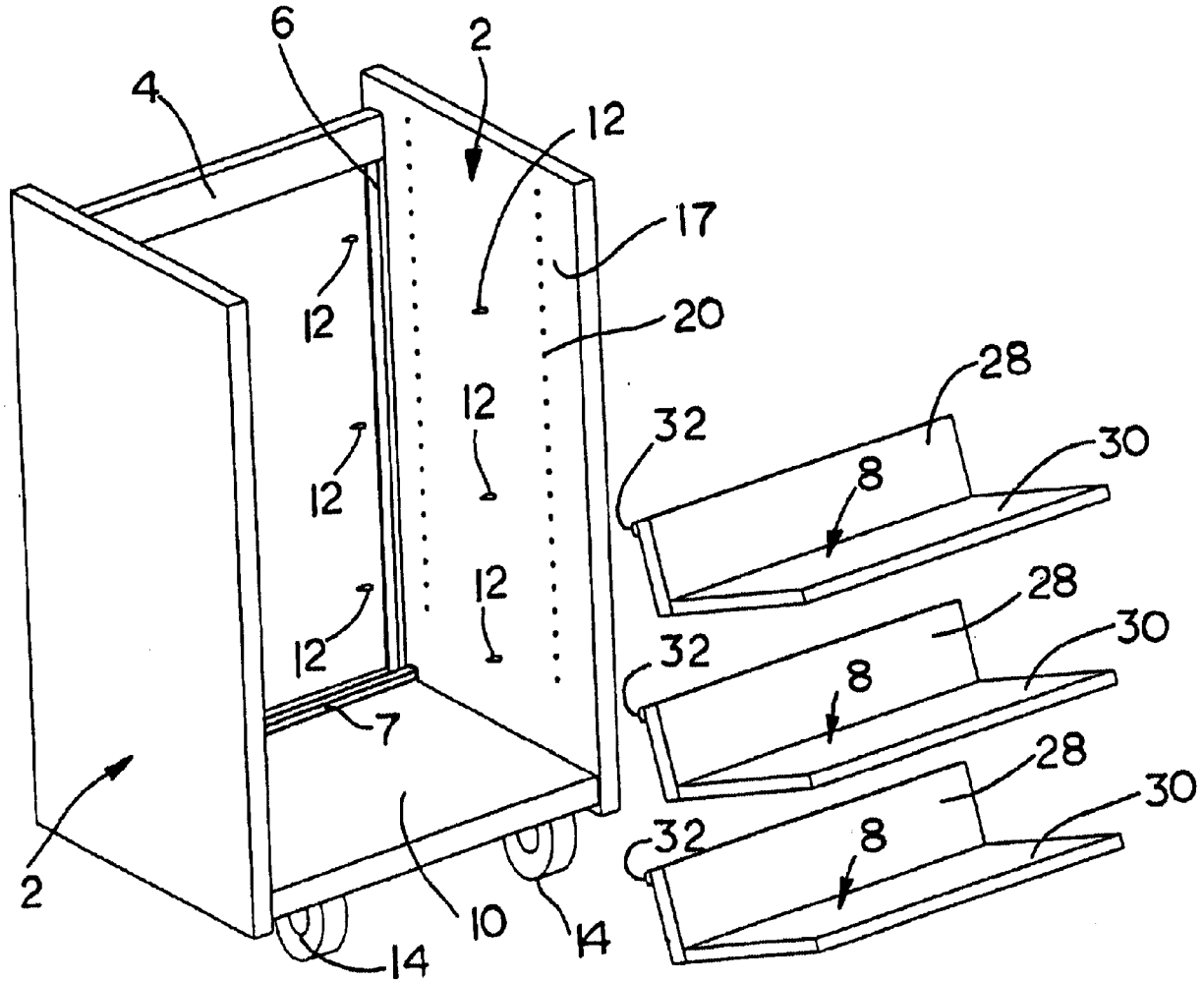
FIG. 6 is a perspective view of the shelving unit in the second operative position showing the component parts in exploded form.
Figure 7:
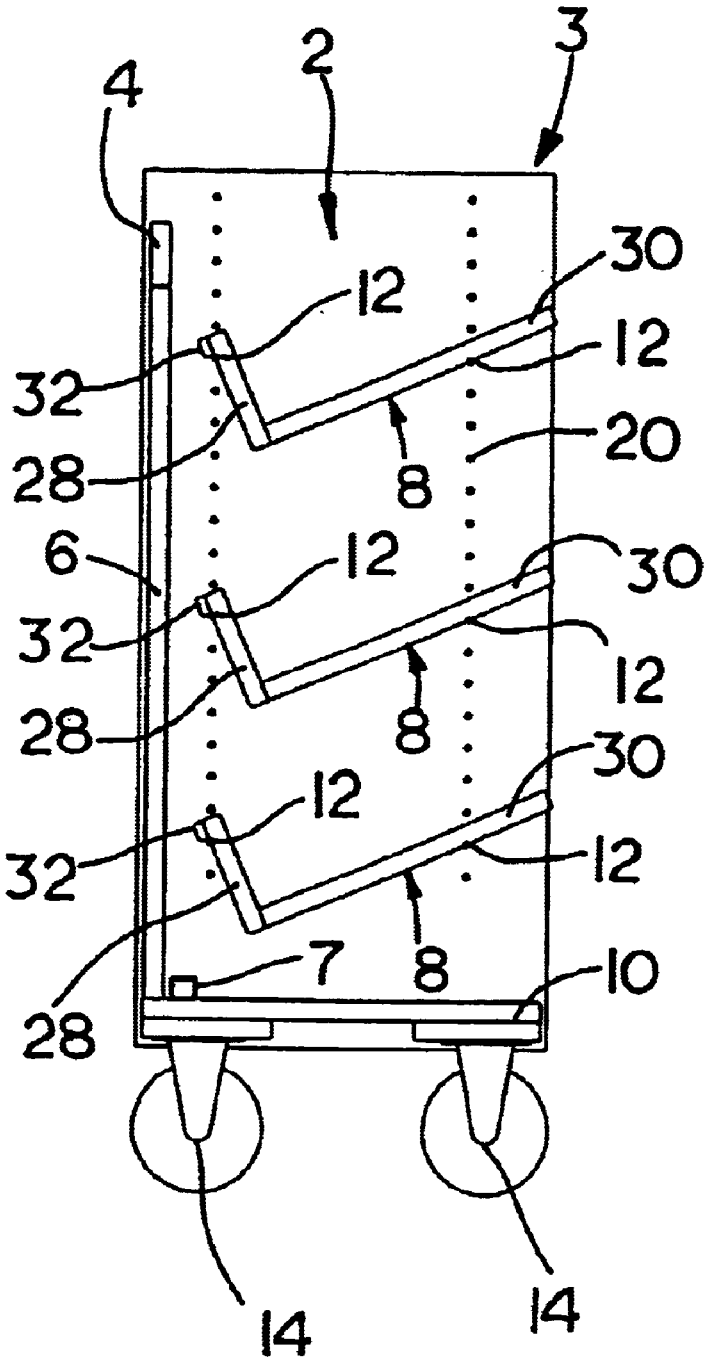
FIG. 7 is a vertical sectional view showing the shelving unit in the second operative position.
Figure 8:
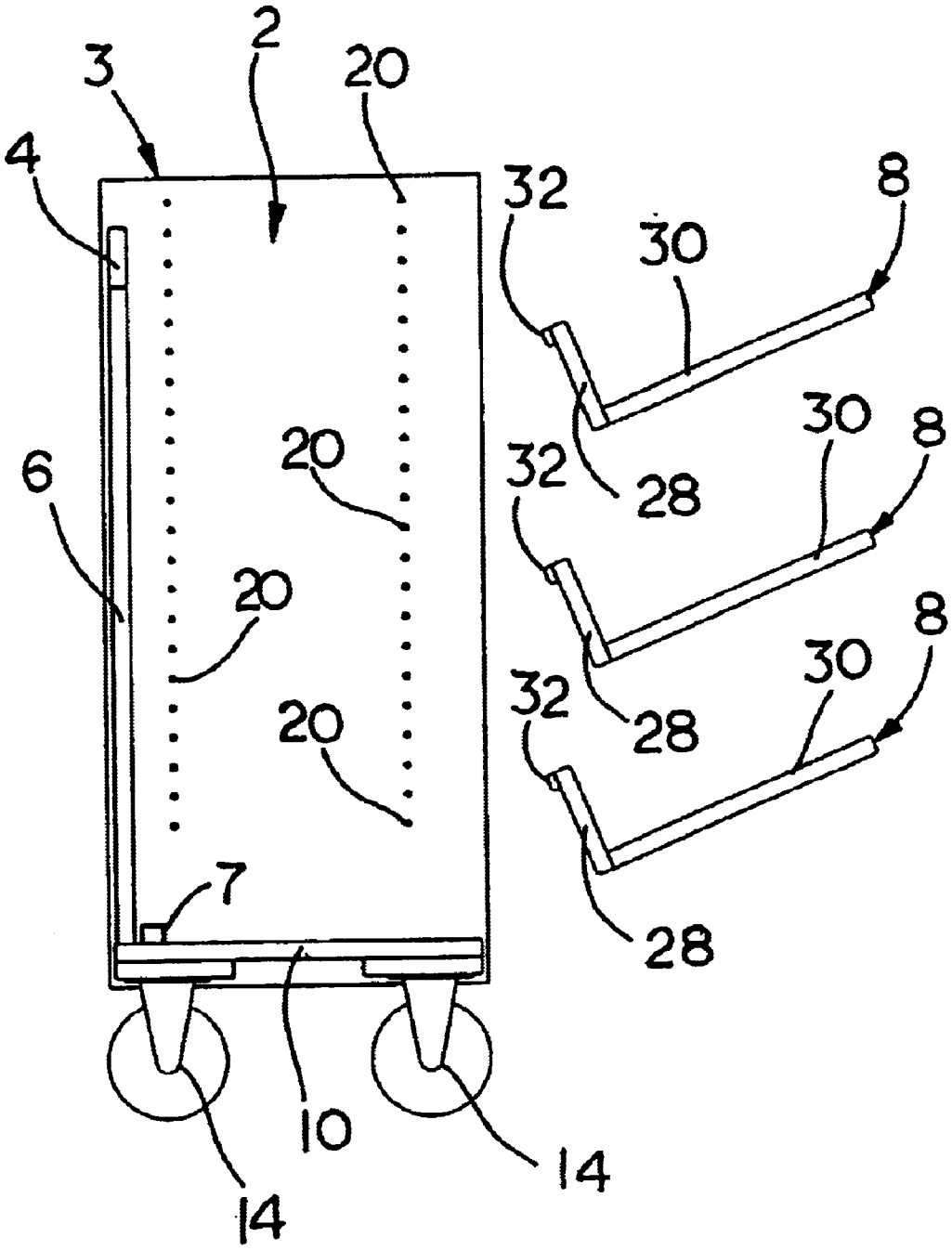
FIG. 8 is a vertical sectional view showing the component parts of the shelving unit in the second operative position in exploded form.

As seen in FIGS. 5 and 7, shelving 8 is placed in a second operative position. In this second position, the pins 12 are again located in a horizontally supportive position. In this position, shelf catch 32 rests on the back pins 12 and shelf wall part 30 in rests on the front pins 12. This second position allows for the display of books or other similar types of items in a sloped storage location.

Figure 9:
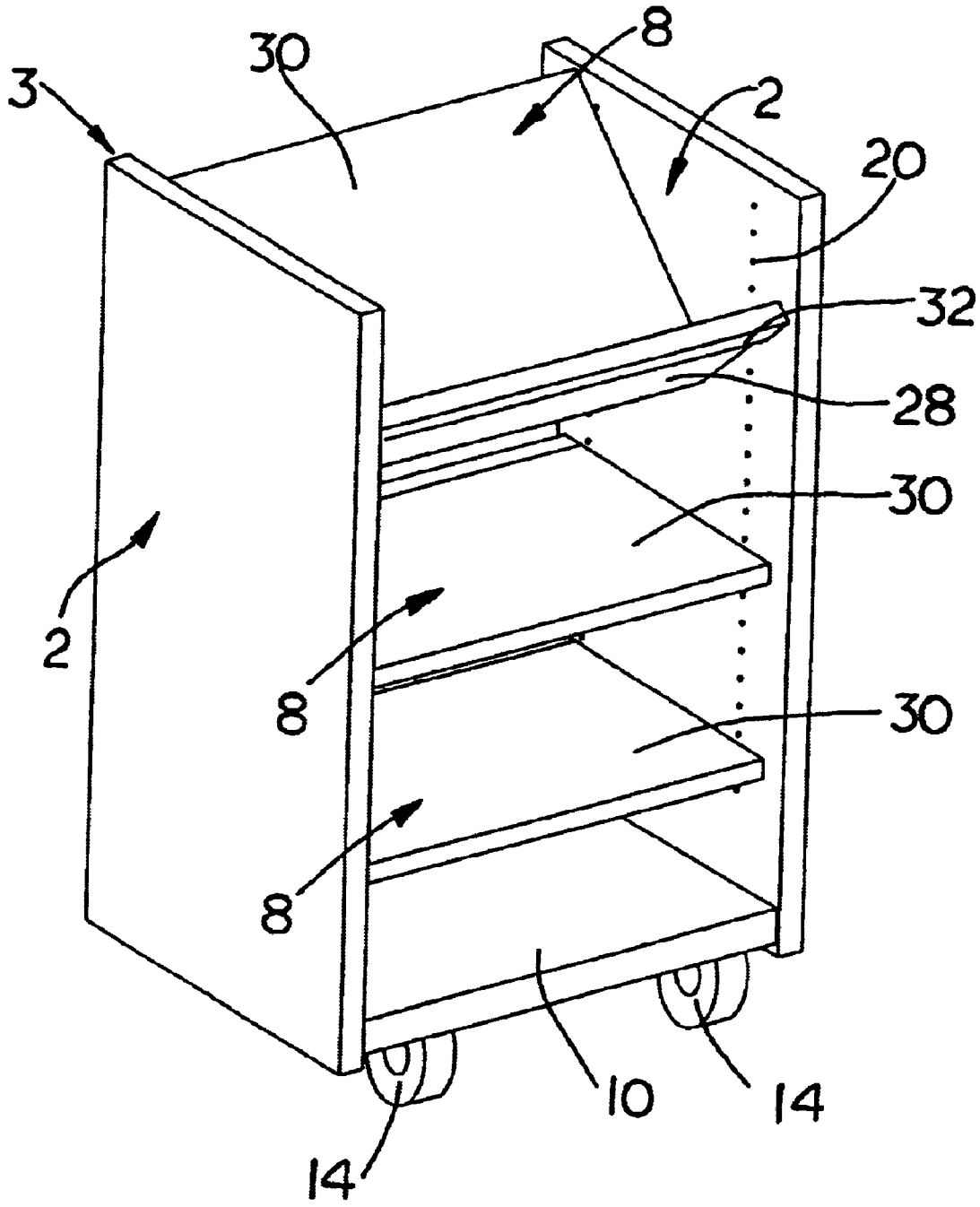
FIG. 9 is a perspective view of the shelving unit in a third operative position having a combined horizontal and sloped configuration.
Figure 10:
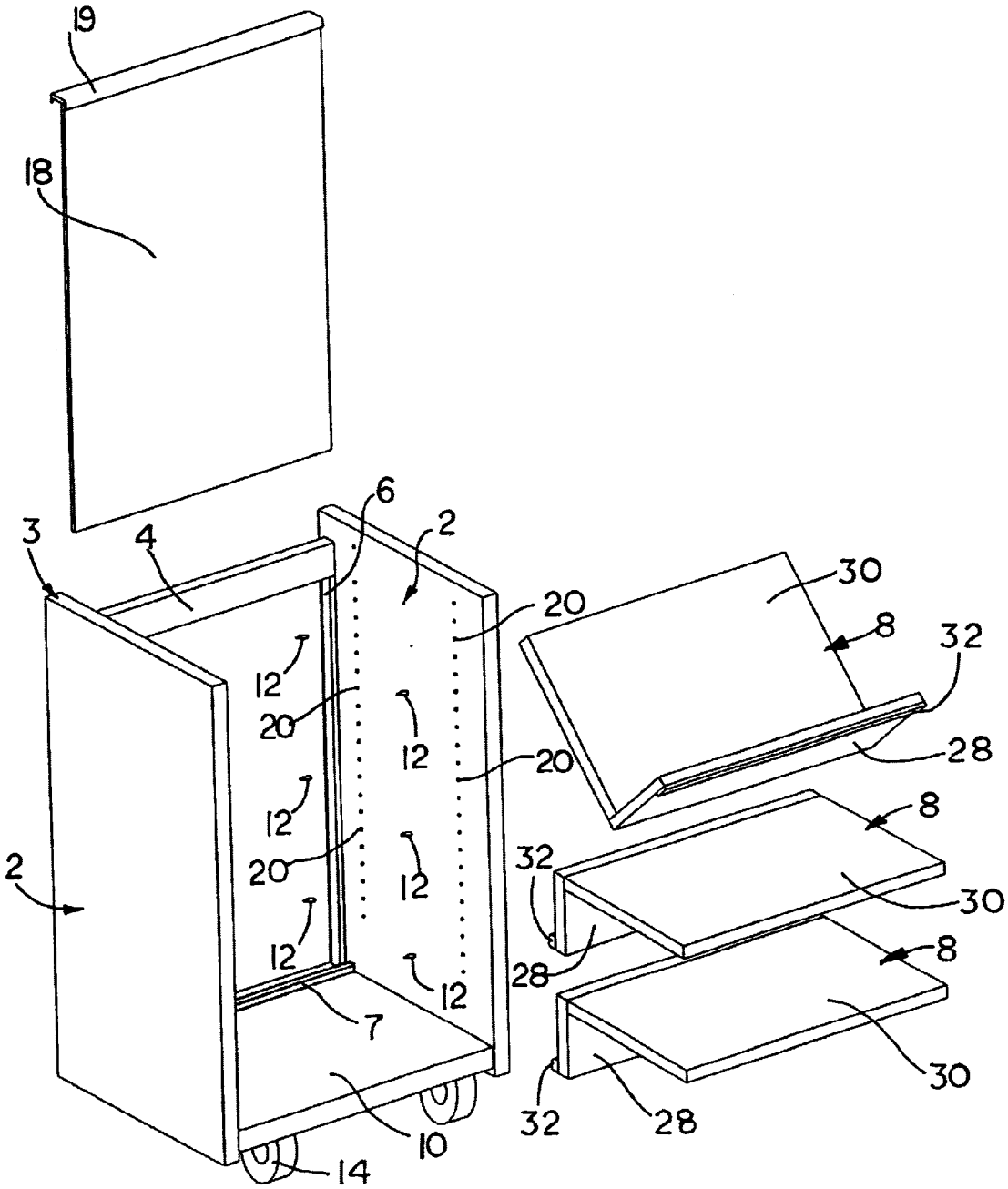
FIG. 10 is a perspective view of the shelving unit in a third operative position showing the component parts in exploded form.
Figure 11:
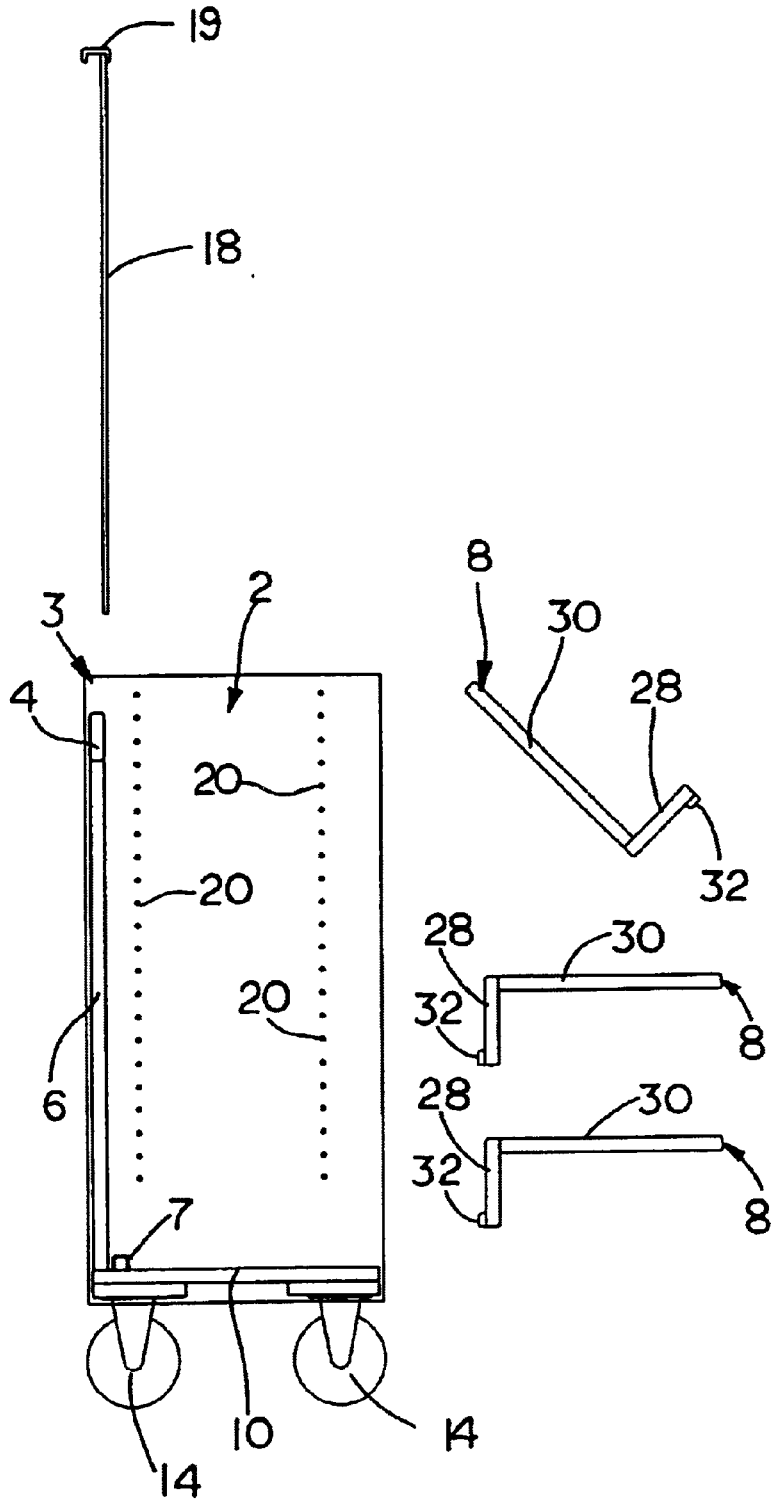
FIG. 11 is a vertical sectional view showing the component parts of the shelving unit in the third operative position exploded form
Figure 12:
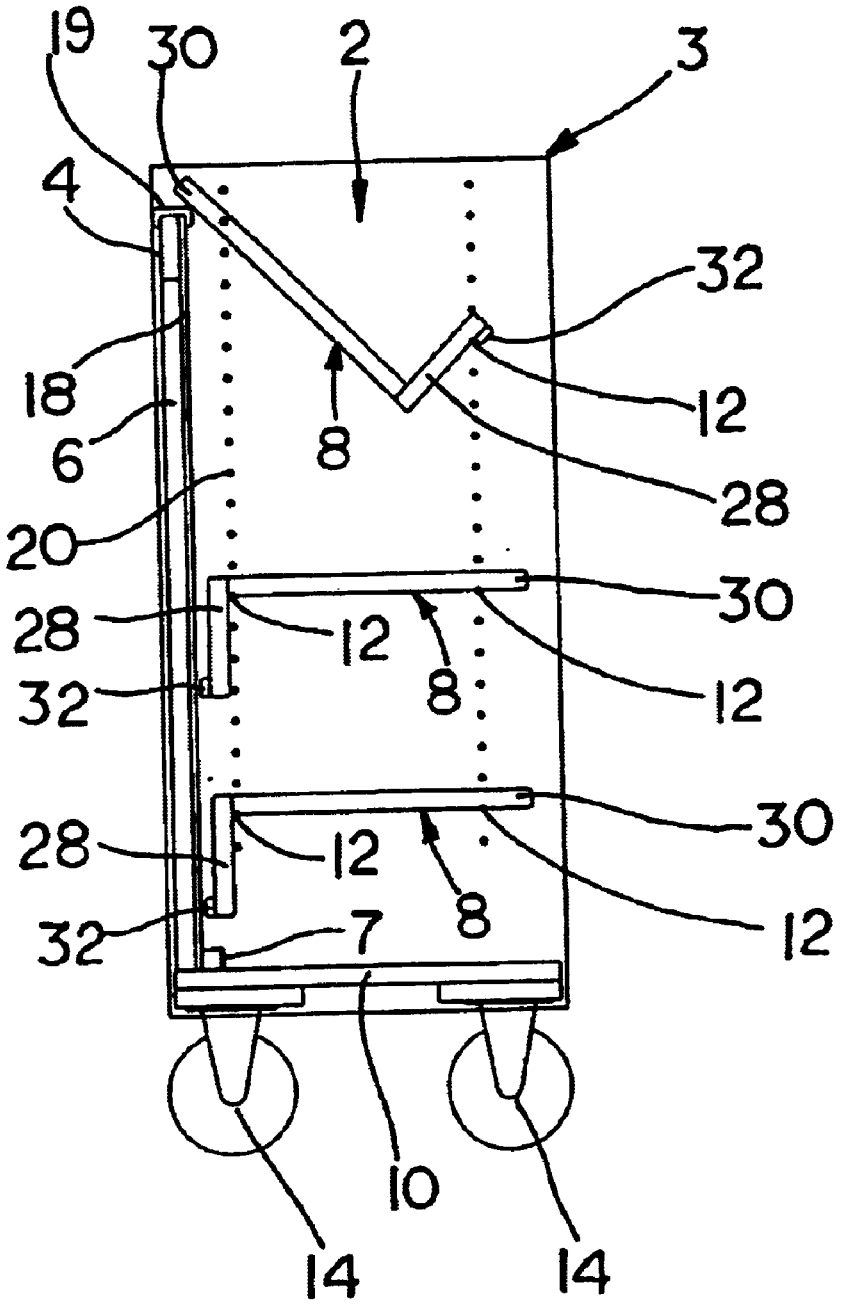
FIG. 12 is a vertical sectional view showing the shelving unit in the third operative position.

As seen in FIGS. 9 and 12 the upper most shelf 8 is placed in a third operative position. In the third position the pins 12 are off set vertically in which wall part 30 rests on the back pins 12 located in a higher vertical position that the front pins. Shelf catch 32 rests on the lower front pins 12. This third position allows for the display of open books or other similar items. As also seen in FIGS. 5, 9, and 12, the two lower shelves are placed in the second position, therefore emphasizing the versatility of an adaptable shelving unit as mentioned above. If desired, back panel 18 can be removed, and the remaining shelves 8 can be placed in the third or display position by relocating pins 12.

Shelving unit 1 can also be used as a lectern by moving the uppermost shelf 8 upwardly with the relocation of its supporting pins 12 to the uppermost holes 20 in side panel 2.

This invention is not to be limited by the above described but it may be modified within scope of the appended claim.

I claim:

1. A convertible shelving unit having adaptable shelves; said shelving unit comprising a frame including two sidewalls, each shelf including two wall parts, each of said wall parts having first and second end edges, said first wall part being joined at its said first edge to said first end edge of second wall part forming with said wall part a general right angle to each other, each of said frame sidewalls carrying laterally spaced retainers, each retainer being locatable at selected vertically spaced locations along the supporting sidewalls, each shelf having a first operative position with said first wall part resting upon said retainers to locate said wall part in a horizontally supportive position between said frame side walls, each shelf having another operative position with said first wall part and said second wall part resting upon said retainers to locate said wall parts in a cradle supportive position.

2. The assembly of claim 1 wherein said second wall part of each shelf includes a catch part at its said second end edge, said catch overlying said retainers when said shelf is in said other position.

3. The assembly of claim 1, wherein said retainers at each side wall are off set vertically and said shelf in its other operative position resting upon said offset retainers with its said first wall part being supported by the uppermost off set retainer and its said second wall part being supported by the lowermost offset retainer.

4. The assembly of claim 1 wherein said frame includes a bottom wall, said sidewalls extending upwardly from said bottom wall, and a removable back wall extending between said sidewalls.

5. The assembly of claim 1 and wheels supporting said frame.

6. The assembly of claim 1, wherein each said shelf is inverted when in its said another operative position in relation to its said first operative position.

7. A convertible shelving unit having adaptable shelves, said shelving unit comprising a frame including two sidewalls, each shelf including two wall parts, each of said wall parts having first and second end edges, said first wall part being joined at its said first edge to said first end edge of second wall part forming with said wall part a general right angle to each other, said second wall part of each shelf including a catch part at its said second end edge, each of said frame sidewalls carrying laterally spaced retainers, each retainer being selectively locatable at a plurality of vertically spaced locations along the supporting sidewalls, each shelf having three positions carried by said retainers including: a first position in which said retainers are horizontally aligned, said first wall part carried horizontally by said retainers; a second position in which said retainers are horizontally aligned, said shelf supportively positioned inverted from said first position, said first and second wall parts carried by said retainers to position said shelf in a cradle supportive position, said catch overlying one of said retainers; and a third position in which said retainers at each side wall are off set vertically, said shelf supportively positioned, its said first wall part supported by each uppermost retainer, its said second wall part supported by each lowermost retainer, said catch overlying said lowermost offset retainer.

* * * * *